US005517941A

United States Patent [19]

Fisher

[11] Patent Number: 5,517,941

[45] Date of Patent: May 21, 1996

[54] PENNANT CONSTRUCTION FOR A VEHICLE ANTENNAE

[76] Inventor: Kevin Fisher, 2310 Whitetail Ct., Reston, Va. 22091

[21] Appl. No.: 466,179

[22] Filed: Jun. 6, 1995

[51] Int. Cl.[6] ..... G09F 17/00; G09F 7/12

[52] U.S. Cl. ..... 116/173; 116/28 R; 40/591; 40/594

[58] Field of Search ..... 116/28 R, 173–175; 40/588, 591, 592, 594, 606, 607, 617

[56] References Cited

U.S. PATENT DOCUMENTS

| | | | |
|---|---|---|---|
| 2,856,891 | 10/1958 | Solomon | 116/173 |
| 3,107,648 | 10/1963 | Lundstrom . | |
| 3,127,868 | 4/1964 | Guthrie | 116/173 |
| 3,495,568 | 2/1970 | Palinkos . | |
| 3,636,912 | 1/1972 | Kamp | 116/28 R |
| 3,766,854 | 10/1973 | Scarlet . | |
| 3,788,269 | 1/1974 | Scarlet . | |
| 3,895,348 | 7/1975 | Palermo | 116/173 |
| 4,177,750 | 12/1979 | Scarlet . | |
| 4,813,369 | 3/1989 | Moreland | 116/173 |
| 4,906,503 | 3/1990 | De La Cruz et al. | 116/173 |
| 4,987,848 | 1/1991 | Todd | 116/173 |
| 5,005,512 | 4/1991 | Fu | 116/173 |
| 5,207,174 | 5/1993 | Fabbrini | 116/173 |
| 5,246,517 | 9/1993 | Watson . | |
| 5,299,525 | 4/1994 | Romesburg . | |

FOREIGN PATENT DOCUMENTS

| | | | |
|---|---|---|---|
| 1097491 | 7/1955 | France | 116/173 |

*Primary Examiner*—William A. Cuchlinski, Jr.
*Assistant Examiner*—Andrew Hirshfeld
*Attorney, Agent, or Firm*—Henderson & Sturm

[57] ABSTRACT

A pennant construction (10) for a vehicle antennae (100) comprising a pennant member (20) fabricated from a very thin, lightweight, and strong material (21) formed into a generally triangular configuration and having an adhesive strip (24) formed on one side and adjacent one edge of the pennant member (20) for adhesively securing the pennant member (20) both to the antennae (100) and itself.

15 Claims, 2 Drawing Sheets

PENNANT CONSTRUCTION FOR A VEHICLE ANTENNAE

TECHNICAL FIELD

The present invention relates to the field of pennants and flags in general, and in particular to a pennant construction specifically designed for attachment to a vehicle antennae such as a car, truck or the like.

BACKGROUND ART

As can be seen by reference to the following U.S. Pat. Nos. 3,107,648; 3,495,568; 3,766,854; and 5,299,525; the prior art is replete with myriad and diverse pennant constructions designed to be attached to a vehicle antennae or similar structure.

While all of the aforementioned prior art constructions are more than adequate for the basic purpose and function for which they have been specifically designed, they are also uniformly deficient in a number of significant instances in that they have an extremely limited useful lifespan, they are fabricated for the most part from fragile material that frays and/or deteriorates rapidly; they are extremely difficult to maintain in a fixed position on the antennae when the vehicle is moving at a high rate of speed; and, they are mainly fabricated from relatively heavy material that generate excessive strain on the antennae structure.

Given the fact that pennants already enjoy widespread usage to identify allegiance to various schools, universities, organizations, and professional sports teams; it is rather surprising that to date someone has not developed a new pennant construction that is lightweight, inexpensive, long lasting and which is simple to affix to a car radio antennae.

It should also be noted that such a construction should reasonably be expected to enjoy an even more widespread usage by virtue of its anticipated adoption by other diverse groups including: sportsmen such as big game hunters and deep sea fishermen to provide a visual indicia on their vehicles representative of their respective trophies; as well as by parents indicating the birth and sex of their newborn babies; and, other individuals wishing to provide visual notice of other myriad and diverse events, affiliations, and occasions.

As a consequence of the foregoing situation, there has existed a longstanding need for a new type of pennant construction which will fulfill the foregoing objectives in a simple, inexpensive and straightforward manner; and, the provision of such a construction is a stated objective of the present invention.

DISCLOSURE OF THE INVENTION

Briefly stated, the pennant construction that forms the basis of the present invention comprises a very thin film or sheet of strong lightweight material that is severed into a generally elongated triangular pennant configuration and further provided with a strip of adhesive material on one side and along one edge of the pennant member.

As will be explained in greater detail further on in the specification, the new pennant construction is intended to adhere both to the surface of the antennae as well as to adhesively join opposed faces of the pennant member to one another, to create the operative connection between the pennant and antennae such that the pennant will remain in a fixed location relative to the antennae during the useful life of the pennant.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
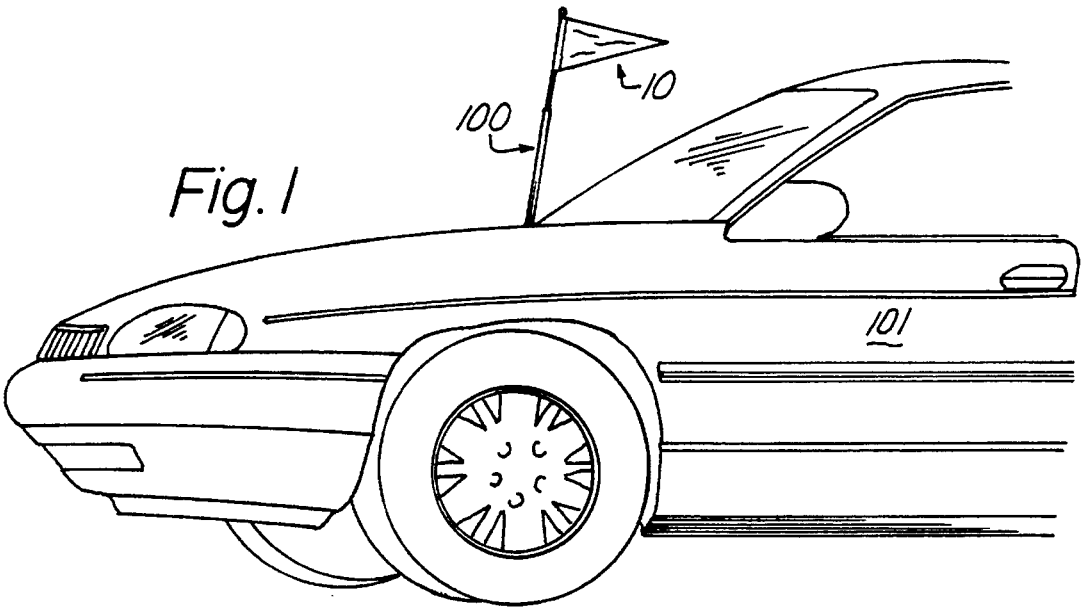
FIG. 1 is a perspective view of the pennant construction that forms the basis of the present invention mounted on the antennae of a vehicle.
Figure 2:
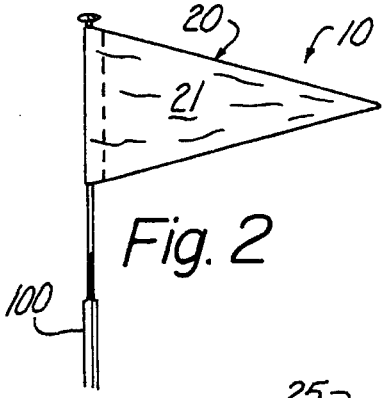
FIG. 2 is an isolated perspective view of the pennant and antennae.

As can be seen by reference to the drawings, and in particular to FIG. 1, the pennant construction that forms the basis of the present invention is designated generally by the reference numeral (10); and, is designed and intended to be fixedly secured to the antennae (100) of a vehicle (101).

The pennant construction (10) comprises in general a pennant member (20) fabricated from a thin sheet of material (21) and having a generally elongated triangular configuration.

In the preferred embodiment of the invention illustrated in the drawings, the pennant (20) is fabricated from a thin, lightweight yet strong material which may be a polyester, "MYLAR" (a trademark of Dupont Corporation) which in addition to the physical properties previously mentioned also will tend to enhance rather than degrade the radio signals received through the antennae (100) to which the pennant is attached.

While "MYLAR" is by far the preferred material (21) from which to fabricate the pennant member (20) due to the superior physical properties that it exhibits, this invention also contemplates the use of a material of bonded polyolefin fibers or "TYVEK" (also a trademark of Dupont Corporation) as well as rip-stop nylon due to their relative thickness lightweight and strength as compared to other materials.

Figure 3:
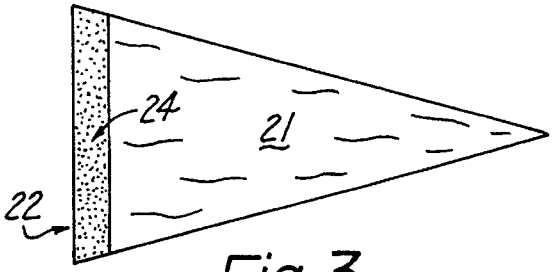
FIG. 3 is a side plan view of the pennant member.

As can best be seen by reference to FIG. 3, the shortest leg or base portion (22) on one side of the pennant member (20) is provided with a strip of adhesive (24) disposed adjacent to the edge of the base portion (22) which is used to operatively secure the pennant member (20) to the periphery of the antennae (100); as well as to permanently affix opposed surfaces of the pennant member (20) to one another.

Figure 6:
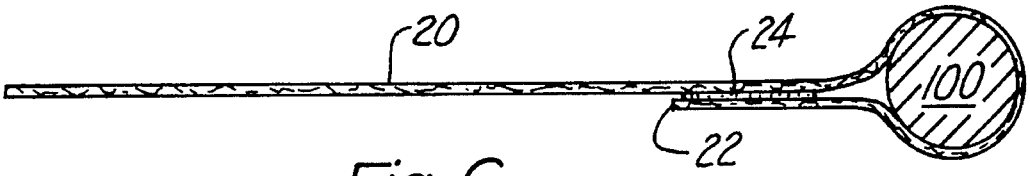
FIG. 6 is a cross-sectional view showing one method of securing the pennant member to an antennae; and, FIG. 7 is a cross-sectional view showing another method of securing the pennant member to an antennae.
Figure 7:
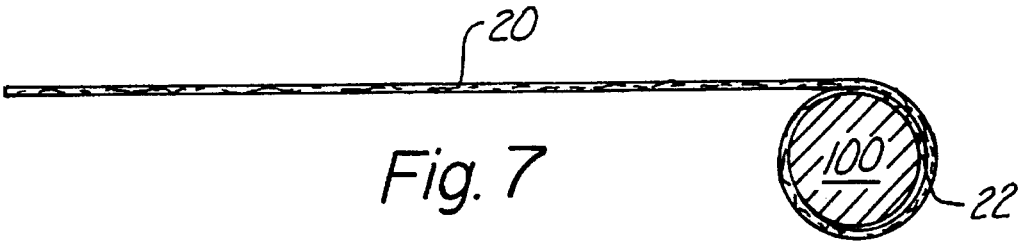
Figure 8:
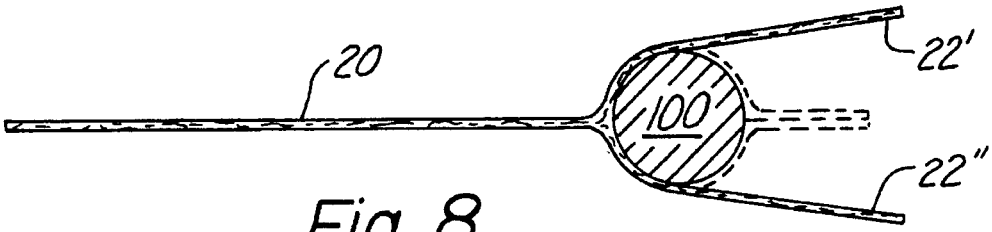
FIG. 8 is a cross-sectional view showing yet another method of securing the pennant member to an antennae.

As shown in FIGS. 6 through 8, there are several methods of securing the pennant member (20) to the antennae (100). In the first method illustrated in FIG. 6, a trailing portion of the adhesive strip (24) is pressed against the front of the antennae (100) and the leading portion of the adhesive strip (24) is brought into contact with a pennant surface disposed on the same side of the pennant (20) that bears the adhesive strip (24).

In the second method of securing the pennant member (20) to the antennae (100) shown in FIG. 7 the leading portion of the adhesive strip (24) is brought into contact with the outer periphery of the antennae (100) and the adhesive bearing side of the pennant is wrapped around the antennae (100) until it eventually sealingly engages the opposite side of the pennant.

In the third method of securing the pennant member (20) to the antennae (100) depicted in FIG. 8, the base portion (22) of the pennant member (20) is bifurcated, and the interior opposed faces (22') and (22") are provided with adhesive layers (24). The opposed faces (22') and (22") then contact opposite sides of the antennae (100), and then sealingly engage each other as indicated by the dashed lines to permanently secure the pennant member (20) to the antennae (100).

Figure 4:
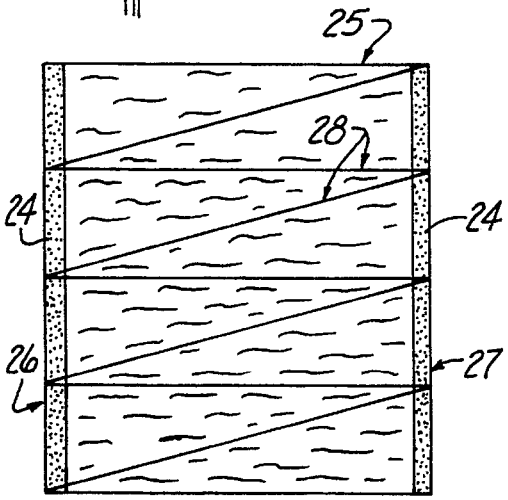
FIG. 4 is a side plan view of a sheet of pennant material having sever or score lines designed to produce a pair of right triangle pennant configurations and a plurality of isosceles triangle pennant configurations.
Figure 5:
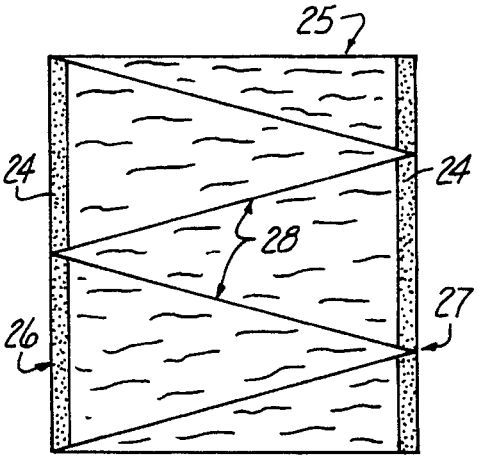
FIG. 5 is a side plan view of a sheet of pennant material having sever or score lines designed to produce a plurality of pennant members having an isosceles triangle pennant configuration.

Turning now to FIGS. 4 and 5, it can be seen that a number of individual pennants can be fabricated from a single elongated rectangular sheet (25) of material (21) having adhesive strips (24) formed along the opposed longitudinal sides (26) (27) of the sheet (25); wherein, the sheet (25) is severed or provided with score lines (28), to create right triangle and isosceles triangle shaped pennant configurations.

By now it should be appreciated that the use of "MYLAR" material (21) coupled with the adhesive strip (24) at the base (22) of the pennant member (20) produces a pennant construction (10) that: adheres directly to the antennae (100); adds minimal weight and aerodynamic strain to the antennae (100); reduces the likelihood of radio signal degradation thru the antennae (100); is relatively inexpensive to produce, simple to use, and has an extremely long useful life; and, otherwise is substantially superior to ant other known pennant construction.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A pennant construction for a vehicle antennae comprising a pennant member having a generally triangular configuration having a base portion and two leg portions and fabricated from a thin sheet of lightweight material having opposed faces; wherein, one face of the pennant member is provided with at least one strip of adhesive disposed adjacent to the base portion of the pennant member for adhesively securing the pennant member both to the antennae and to itself; and, wherein the adhesive strip engages the other face of the pennant member.

2. The pennant construction as in claim 1; wherein, the generally triangular configuration represents a right triangle.

3. The pennant construction as in claim 1; wherein, the generally triangular configuration represents an isosceles triangle.

4. The pennant construction as in claim 1; wherein, said material comprises a thin strong polyester material.

5. The pennant construction as in claim 1; wherein, said material comprises a material having bonded polyolefin fibers.

6. The pennant construction as in claim 1; wherein, said material comprises rip-stop nylon.

7. The pennant construction as in claim 1; wherein, said base portion is bifurcated and at least one of the opposed faces of the bifurcated base portion is provided with said at least one strip of adhesive.

8. A pennant construction for a vehicle antennae consisting of:

a pennant member having a generally triangular configuration having a base portion and two leg portions and fabricated from a thin sheet of lightweight material having opposed faces; wherein, one face of the pennant member is provided with at least one strip of adhesive disposed adjacent to the base portion of the pennant member for adhesively securing the pennant member both to the antennae and to itself, wherein the adhesive strip engages the other face of the pennant member.

9. The pennant construction as in claim 8; wherein, the generally triangular configuration represents a right triangle.

10. The pennant construction as in claim 8; wherein, the generally triangular configuration represents an isosceles triangle.

11. The pennant construction as in claim 8; wherein, said material comprises a thin strong polyester material.

12. The pennant construction as in claim 8; wherein, said material comprises a material having bonded polyolefin fibers.

13. The pennant construction as in claim 8; wherein, said material comprises rip-stop nylon.

14. The pennant construction as in claim 8; wherein, said base portion is bifurcated and at least one of the opposed faces of the bifurcated base portion is provided with said at least one strip of adhesive.

15. The pennant construction as in claim 14; wherein, said other face includes additional adhesive thereon.

* * * * *